US005961066A

United States Patent [19]

Hambleton

[11] Patent Number: 5,961,066

[45] Date of Patent: Oct. 5, 1999

[54] TAPE DISPENSER

[76] Inventor: Robert A. Hambleton, 37861 Cresia Del Reyo, Murrieta, Calif. 92563

[21] Appl. No.: 09/175,373

[22] Filed: Oct. 19, 1998

[51] Int. Cl.[6] ..... B65H 19/28

[52] U.S. Cl. ..... 242/588.1; 242/404.1; 242/597.05; 224/162; 224/267

[58] Field of Search ..... 242/588.1, 404.1, 242/405, 597.5, 597.7; 224/162, 255, 179, 267, 219, 221, 222

[56] References Cited

U.S. PATENT DOCUMENTS

| | | | |
|---|---|---|---|
| 1,577,272 | 3/1926 | Treadaway | 242/404.1 X |
| 2,513,892 | 7/1950 | Pile | 224/179 |
| 2,525,992 | 10/1950 | Wynn | 242/588.1 |
| 3,705,697 | 12/1972 | Chagnon | 242/404.1 X |
| 3,921,936 | 11/1975 | Suter | 242/588.1 |
| 3,980,245 | 9/1976 | Delehoy | 242/588.1 X |
| 3,993,230 | 11/1976 | Oakes | 225/47 |
| 4,625,931 | 12/1986 | Tamura et al. | 242/597.5 X |
| 4,738,385 | 4/1988 | Bell | 242/597.7 X |
| 4,880,152 | 11/1989 | Trankle | 224/162 |
| 4,928,864 | 5/1990 | Walker | 224/162 |
| 5,115,648 | 5/1992 | Salvucci | 242/405 X |
| 5,215,236 | 6/1993 | Waddell | 224/218 |
| 5,358,141 | 10/1994 | Carlson | 221/185 |
| 5,570,853 | 11/1996 | Teng | 242/597.5 X |

FOREIGN PATENT DOCUMENTS

| | | | |
|---|---|---|---|
| 669402 | 6/1979 | U.S.S.R. | 242/597.7 |

*Primary Examiner*—Donald P. Walsh
*Assistant Examiner*—Minh-Chau Pham
*Attorney, Agent, or Firm*—Goldstein & Canino

[57] ABSTRACT

A hands-free tape dispenser for dispensing adhesive tapes of varying widths and quantities. The tape dispenser is attached to a user's wrist or arms, and comprises a U-shaped body having a flat top portion, a left sidewall extending downwards from the left edge of the top portion and a right sidewall extending downwards from the right edge of said top portion, a rod protruding from the top portion, a rotary holder for mounting the tape roll, a securing means tightened onto said rod and a plurality of fastening straps extending from the left and right sidewall.

5 Claims, 2 Drawing Sheets

TAPE DISPENSER

BACKGROUND OF THE INVENTION

The present invention relates to a tape dispenser, and, more particularly, to a tape dispenser that allows hands-free extraction of tape.

The most common type of tape dispensers are adhesive tape dispensers which normally include a housing for supporting a spool or roll of adhesive tape in spaced relationship with a cutter. Conventional adhesive tape rolls are manufactured in standardized sizes so as to be adaptable to home or office dispensers. Therefore, when a roll of adhesive tape is exhausted, a replacement roll may be easily mounted to a dispenser.

As opposed to replacement type dispensers, there are other types of adhesive tape dispensers which are inexpensively manufactured to be disposed of once a single roll of tape has been fully dispensed. Such dispensers are normally constructed of a combination of plastic and cardboard type materials.

Tape dispensers are often awkward to use. Most conventional adhesive tape dispensers, which are of low cost and available to the consumers, require that the tape dispenser be held with one hand while the tape is extracted and cut with the other. This means that the package that is being wrapped with the adhesive tape must be released until the tape is cut. Additionally, often the cut tape folds on itself and adheres to itself, thereby necessitating that the tape be pulled apart before it can be utilized.

To alleviate the problems of the traditional tape dispensers, some have proposed tape dispensers designed to be worn to a person's wrist or fingers. U.S. Pat. No. 3,993,230 to Oakes discloses an adhesive tape dispenser having one or more openings through which a person's fingers may be extended to support the tape dispenser relative to the hand. While this dispenser allows the user to utilize both hands, it suffers from the drawback that the dispenser must be supported by one or more fingers so that the physical dexterity of the user is interfered with during tasks such as wrapping, holding or supporting packages relative to the tape dispenser.

U.S. Pat. No. 4,928,864 to Walker et al. discloses a portable dispenser for dispensing tape materials which includes a base portion formed as a C-shaped or continuous clamp which is engageable over the back of an individual's hand. U.S. Pat. No. 5,215,236 to Waddell discloses a clip-on clamp or bracket which is engageable over the back of an individual's hand which is used to selectively support a conventional disposable tape dispenser. Unfortunately, these known dispensers are generally worn around the user's hands, which restricts the user to using his free hand for extracting tape.

While these units mentioned above may be suitable for the particular purpose employed, or for general use, they would not be as suitable for the purposes of the present invention as disclosed hereafter.

SUMMARY OF THE INVENTION

It is an object of the present invention to provide a tape dispenser that does not require to be held in the user's hands when extracting the tape. Accordingly, a tape dispenser is provided that may be fastened onto the user's arm or wrist.

It is another object of the present invention to provide a tape dispenser for dispensing adhesive tape of various widths and sizes.

It is yet another object of the present invention to provide a tape dispenser that securely holds a roll of adhesive tape.

To accomplish the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
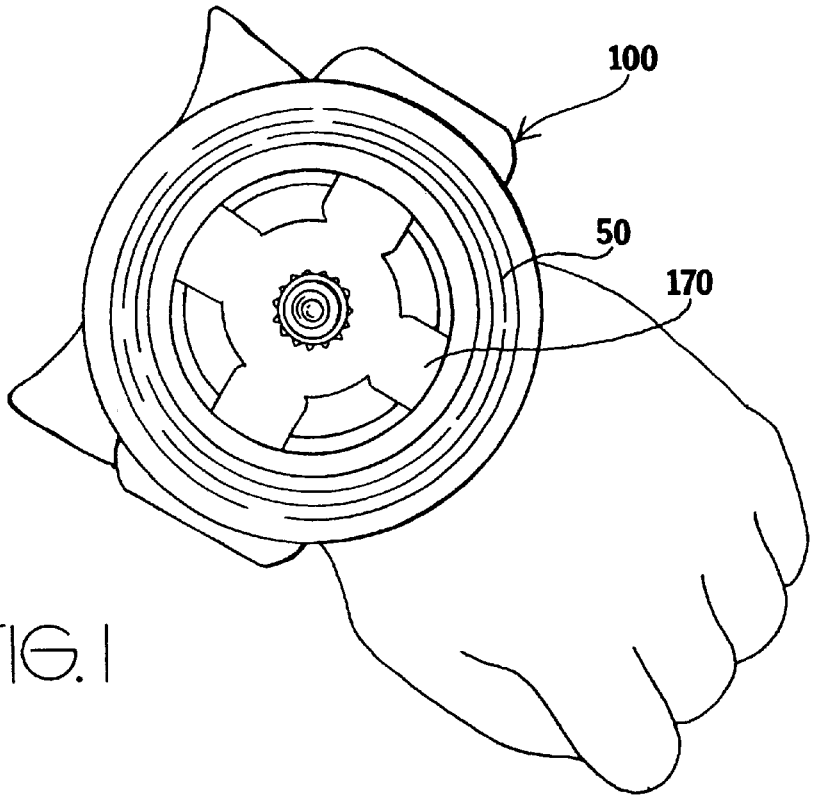
FIG. 1 is a top plan of the tape dispenser having a roll of tape around the user's arms or wrists.
Figure 2:
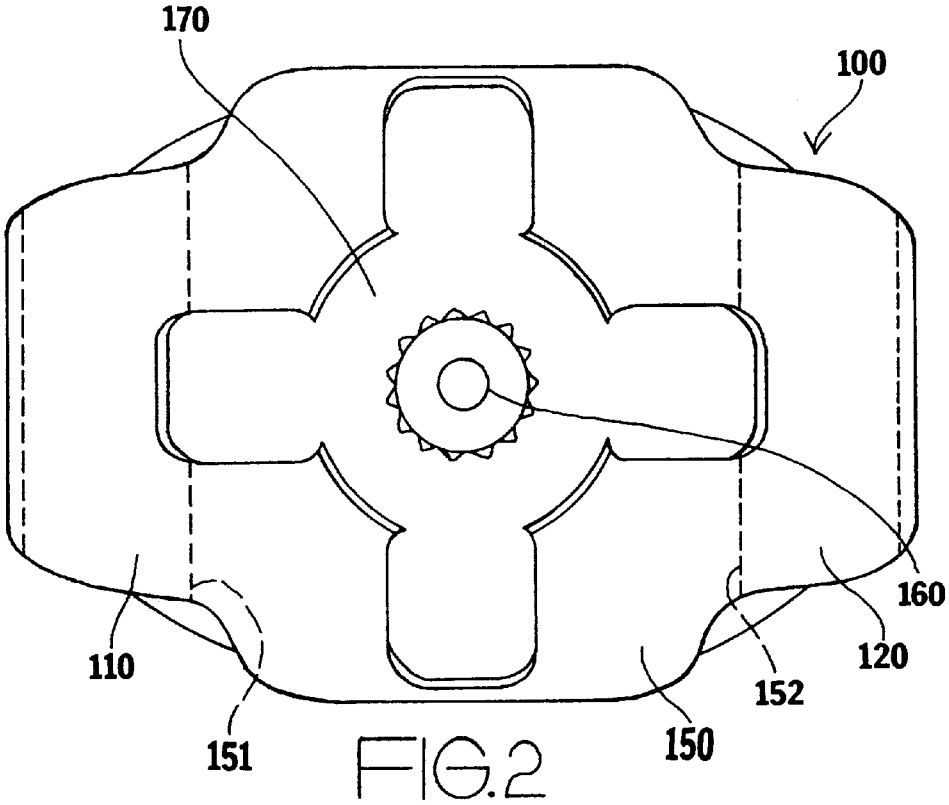
FIG. 2 is a top plan of the tape dispenser without a roll of tape.
Figure 3:
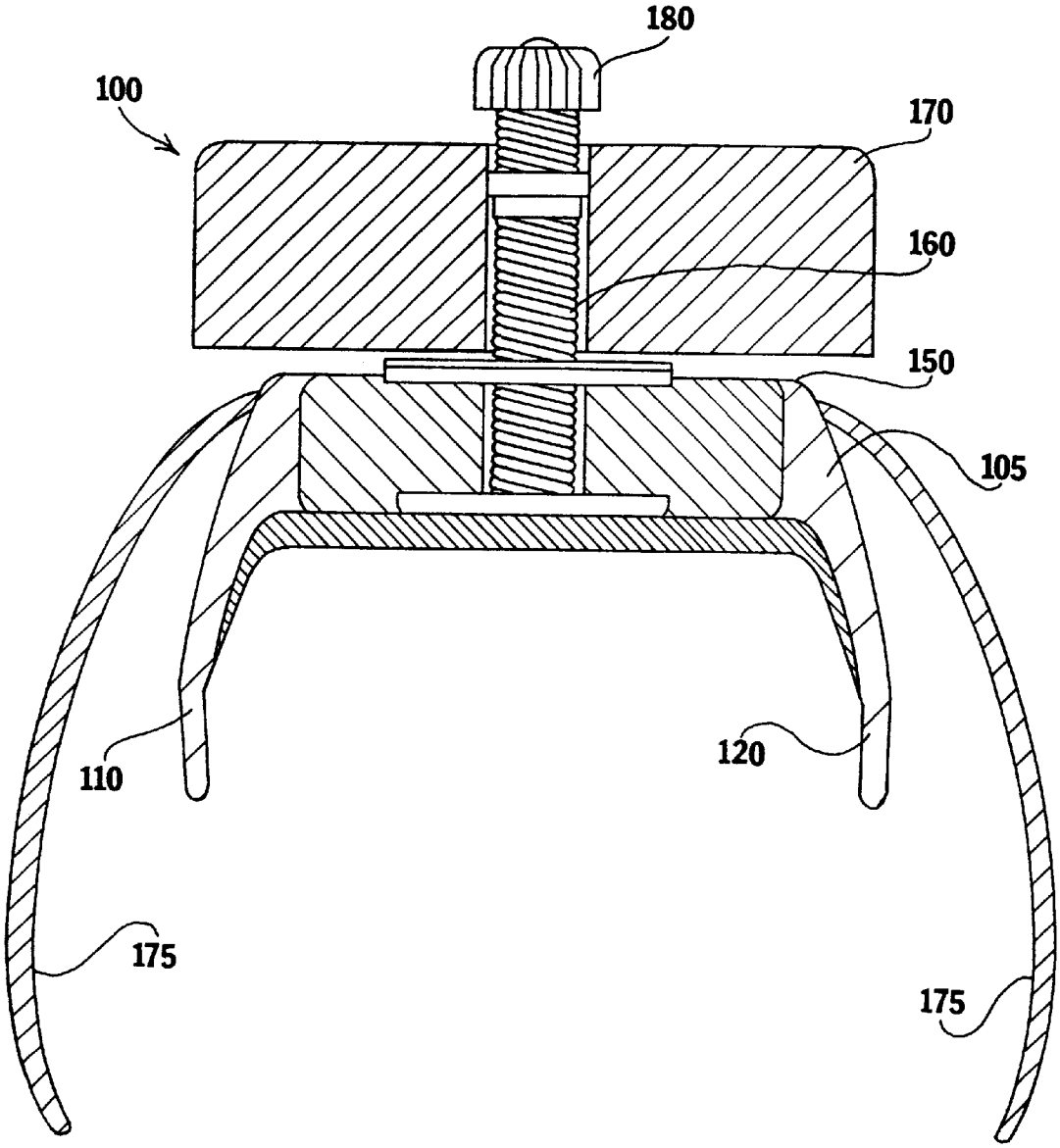
FIG. 3 is a front view of the tape dispenser with a portion of the rotary holder removed to provide a better view of the internal structure of the hands-free tape dispenser.

FIGS. 1–3 refers to a hands-free tape dispenser 100 for securely holding a roll of adhesive tape 50. As shown in FIG. 1, the tape dispenser 100 may be securely fastened onto a user's wrist or arms. The tape dispenser 100 may be fastened onto the left or right wrist or arm, depending on the user's preference.

Referring to FIG. 3, the tape dispenser 100 comprises a U-shaped body 105 having a flat top portion 150, a left sidewall 110 and a right sidewall 120. As shown in FIG. 2, the left sidewall 110 extends downwardly from the left edge 151 of the top portion 150 and the right sidewall 120 extends downwardly from the right edge 152 of the top portion 150. The left sidewall 110 and the right sidewall 120 are designed such that they rest against or grip around the user's wrist or arm. According to one embodiment, the U-shaped body 105 is made from hard plastic. According to another embodiment, the U-shaped body 105 is made from a metallic substance, such as steel or the like.

As shown in FIG. 3, a rod 160 protrudes from the center of the top portion 150 of the U-shaped body 105. According to one embodiment, the rod 160 is a spring-loaded threaded bolt. The scope of the present invention, however, is not limited by the exact nature of the rod 160, and it is possible to have other embodiments, such as a simple rivet. The rod 160 protrudes approximately two inches from the top portion 150 of the U-shaped body 105 to allow the user to secure adhesive tapes of various widths onto the U-shaped body 105.

A rotary holder 170 is mounted onto rod 160, as shown in FIG. 3. Referring momentarily to FIG. 1, the rotary holder 170 holds the roll of adhesive tape 50 by mounting the roll from its inner surface. Thus, the rotary holder 170 rotates with the roll of adhesive tape 50 when tape is being extracted. The rotary holder 170 is provided with a diameter that corresponds to the diameter of the inner surface of the roll of adhesive tape 50. According to one embodiment, the rotary holder 170 is provided with a diameter of three inches to mount a roll of packing tape.

The top portion of the rod 160 is provided with a securing means 180 which is tightened on the top portion of the rod 160 to hold the rotary holder 170 in place. It is possible to have the outer circumference of the securing means 180 extend over the roll of adhesive tape 50 to ensure that the roll of adhesive tape 50 is securely held onto the tape dispenser 100. The securing means 180 may be a tensioning nut that screws onto a spring-loaded threaded bolt.

The tape dispenser 100 comprises a plurality of fastening means 175 that extend outwards from the left sidewall 110 and the right sidewall 120. The fastening means 175 attach to each other to securedly fasten the tape dispenser 100 over the user's wrist or arm. According to the preferred embodiment, the fastening means 175 are made from a hook and loop fabric material. According to another embodiment, the fastening means 175 are straps that have snap buttons.

Many specific details contained in the above description merely illustrate some preferred embodiments and should not be construed as a limitation on the scope of the invention. Accordingly, many other variations are possible within the true spirit of the present invention, limited only by the scope of the claims that follow.

I claim:

1. A hands-free tape dispenser for dispensing adhesive tapes of varying widths and quantities, wherein the adhesive tapes have a tape width and are rolled on a tape roll having a tape roll diameter, the tape dispenser capable of being secured to a user's wrist, said tape dispenser comprising:

a U-shaped body having a flat top portion, a left sidewall and a right sidewall, said top portion having a left edge and a right edge, said left sidewall extending downward from the left edge of said top portion and said right sidewall extending downward from the right edge of said top portion so that the left sidewall and the right sidewall extend around the user's wrist when the tape dispenser is secured thereto;

a rod protruding from said top portion of the U-shaped body, wherein the rod's height corresponds to the tape width;

a rotary holder for securely mounting the tape roll, wherein said rotary holder has a diameter corresponding to the tape roll diameter and said rotary holder's height corresponds to the tape width, said rotary holder mounted on said rod;

a securing means on top of said rod for securely holding the rotary holder in place; and a plurality of fastening straps extending from said left sidewall and said right sidewall which are attachable to each other for securing the hands-free tape dispenser around the user's wrist.

2. The hands-free tape dispenser of claim 1, wherein said rod protruding from the top surface is a spring-loaded threaded bolt.

3. The hands-free tape dispenser of claim 2, wherein said securing means is a tensioning nut that screws onto said spring-loaded threaded bolt.

4. The hands-free tape dispenser of claim 3, wherein said securing means extends over the tape roll to securely hold the tape roll on the hands-free tape dispenser.

5. The hands-free tape dispenser of claim 1, wherein said securing means extends over the tape roll to securely hold the tape roll on the hands-free tape dispenser.

* * * * *